US006382780B1

(12) United States Patent
Watanabe et al.

(10) Patent No.: US 6,382,780 B1
(45) Date of Patent: May 7, 2002

(54) INKJET HEAD FORMED OF DIVIDED PRESSURE-CHAMBER PLATE, METHOD FOR MANUFACTURING THE SAME, AND RECORDING DEVICE HAVING THE INKJET HEAD

(75) Inventors: Mutsuo Watanabe; Masayuki Sasaki; Kouichi Sanpei; Hiromitsu Soneda; Akihiko Miyaki; Akira Iwaishi, all of Kawasaki; Masahiro Ono, Hitachi; Takumi Kawamura; Tomoyuki Akahoshi, both of Kawasaki, all of (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/427,030

(22) Filed: Oct. 26, 1999

(30) Foreign Application Priority Data

Feb. 8, 1999 (JP) ..... 11-030630
Jun. 30, 1999 (JP) ..... 11-186378

(51) Int. Cl.[7] ..... B41J 2/16; B41J 2/14
(52) U.S. Cl. ..... 347/68

(58) Field of Search ..... 347/54, 20, 69, 347/68, 65, 63, 67, 59, 94

(56) References Cited

U.S. PATENT DOCUMENTS 5,450,110 A * 9/1995 Sato et al. ..... 347/67
6,106,106 A * 8/2000 Nakazawa et al. ..... 347/68

FOREIGN PATENT DOCUMENTS

| | | |
|---|---|---|
| JP | 06183002 A | 7/1994 |
| JP | 06226977 A | 8/1994 |
| JP | 08132639 A | 5/1996 |
| JP | 09300609 A | 11/1997 |

* cited by examiner

*Primary Examiner*—Huan Tran
(74) *Attorney, Agent, or Firm*—Armstrong, Westerman & Hattori, LLP

(57) ABSTRACT

The instant invention has an exemplified object to provide an inkjet head and recording device having such an inkjet head with a simpler structure as achieves higher quality of printing inexpensively than the conventional. The pressure-chamber plate of this invention is slit or divided into a plurality of elements.

19 Claims, 11 Drawing Sheets

INKJET HEAD FORMED OF DIVIDED PRESSURE-CHAMBER PLATE, METHOD FOR MANUFACTURING THE SAME, AND RECORDING DEVICE HAVING THE INKJET HEAD

BACKGROUND OF THE INVENTION

The present invention relates generally to recording devices, and more particularly to a head (i.e., inkjet head) used for an inkjet printer. The inkjet head of the present invention is suitable for both piezo-type and bubble-type inkjet printers, and applicable widely to facsimile machines, computer systems, word processors, and combination machines thereof, in addition to a single printer unit.

Among inkjet heads, a piezo-type inkjet head using a piezo-electric element, for example, has recently become more and more popular for its good energy efficiency and other reasons. This type of inkjet head typically includes a nozzle plate jointed with a three-layer member comprising a pressure-chamber plate, a thin film, and a piezo-electric element. A plurality of pressure chambers and corresponding ink introduction channels, as well as one common ink chamber, are formed in the pressure-chamber plate by grooving a rigid member, such as, glass. Each pressure chamber is connected to a common ink chamber through a corresponding ink introduction channel, and receives ink from the common ink chamber, jetting ink through a nozzle by enhanced internal pressure as a result of deformation of the piezo-electric element.

However, in the conventional inkjet head where each pressure chamber is incorporated with a corresponding ink introduction channel, driving the piezo-electric element generates vibration in the pressure chamber which then propagates to the ink introduction channel and the common ink chamber directly or through the pressure-chamber plate, thereby vibrating supplied ink, and making unstable the subsequent ink jet (e.g., with respect to the amount and velocity of each liquid drop). As a result, the conventional inkjet head disadvantageously has deteriorated printing quality.

SUMMARY OF THE INVENTION

Accordingly, it is a general and exemplified object of the present invention to provide a novel and useful inkjet head and recording device having such an inkjet head in which the above disadvantages are eliminated.

Another, more specific and exemplified object of the present invention is to provide an inkjet head and recording device having such an inkjet head with a simpler structure as achieves higher quality of printing inexpensively than the conventional.

In order to achieve the above objects, an inkjet head of a first aspect of the present invention comprises a pressure-chamber plate which defines a pressure chamber for storing ink, and an ink chamber for supplying the ink to the pressure chamber, and which includes a slit outside a channel between the pressure chamber and the ink chamber, the channel supplying the ink from the ink chamber to the pressure chamber, and a pressurizing member which pressurizes the pressure chamber in the pressure-chamber plate, allowing the ink in the pressure chamber to jet. According to this inkjet head, the slit reduces or eliminates propagations of pressure chamber's vibration and/or deformation to the ink chamber via the pressure-chamber plate when the pressure chamber is pressurized.

An inkjet head of a second aspect of the present invention comprises a pressure-chamber plate which defines a pressure chamber for storing ink, and an ink chamber for supplying the ink to the pressure chamber, the pressure-chamber plate being divided into a plurality of elements, and a pressurizing member which pressurizes the pressure chamber in the pressure-chamber plate, allowing the ink in the pressure chamber to jet. Also in this inkjet head, the divided interface reduces or eliminates propagations of pressure chamber's vibration and/or deformation to the ink chamber via the pressure-chamber plate when the pressure chamber is pressurized.

A recording device of the present invention includes one of the aforementioned inkjet heads, and a drive device which drives the inkjet head. This recording device serves the same effects to the above inkjet heads.

A method for manufacturing an inkjet head of the present invention comprises the steps of adhering, in a pressure-chamber plate which defines a pressure chamber for storing ink, and an ink chamber for supplying the ink to the pressure chamber, the pressure-chamber plate being divided into the plurality of elements, part of elements among a plurality of elements, a thin film, and a piezo-electric element which pressurizes the pressure chamber via the thin film to one another, and forming a nozzle connection surface by abrading at least the part of the elements and the thin film, jointing to the nozzle connection surface a nozzle plate having a nozzle hole through which the ink is jet from the pressure chamber when the piezo-electric element pressurizes the pressure chamber, and adhering remaining elements of the pressure-chamber plate to the part of the elements. The inkjet head made by this method also serves the above effects.

The inkjet head of the present invention is used as a piezo- or bubble-type inkjet head, and thus the pressurizing member may be typically a piezo-electric element in the piezo-type and a heater in the bubble-type.

Other objects and further features of the present invention will become readily apparent from the following description and accompanying drawings.

DETAILED DESCRIPTION OF PREFERRED EMBODIMENTS

Figure 1:
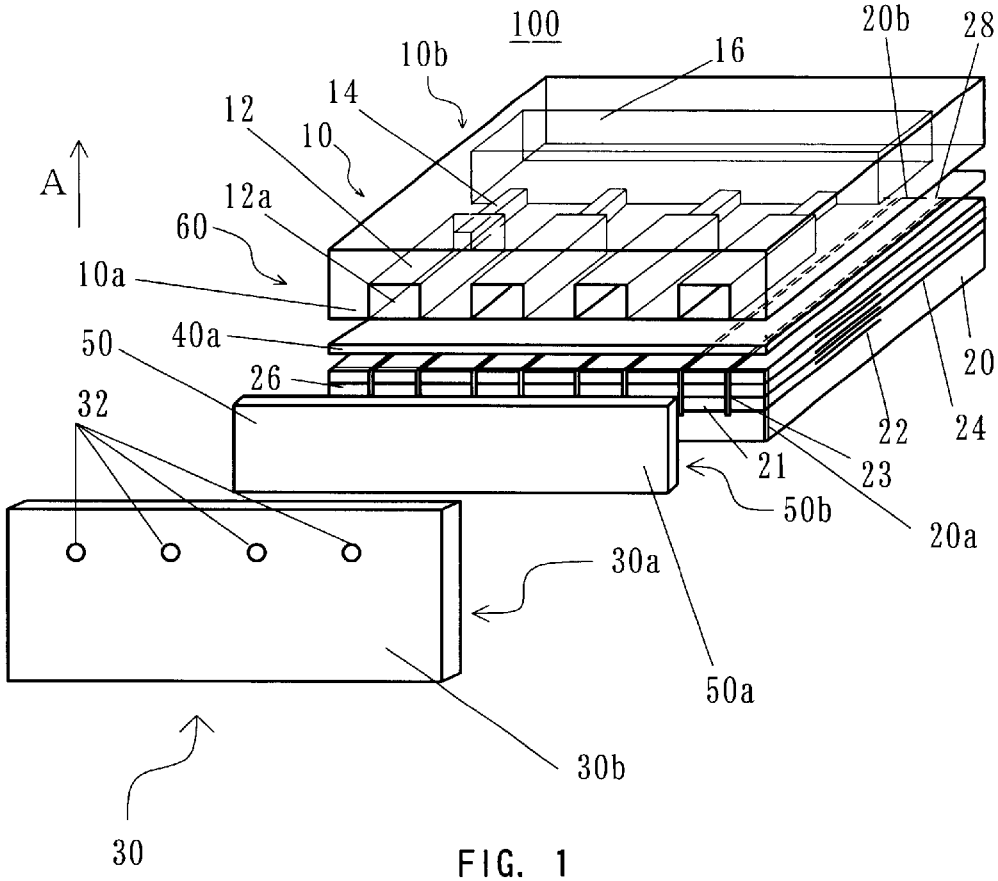
FIG. 1 is an exploded perspective view of an inkjet head of a first embodiment according to the present invention.
Figure 5:
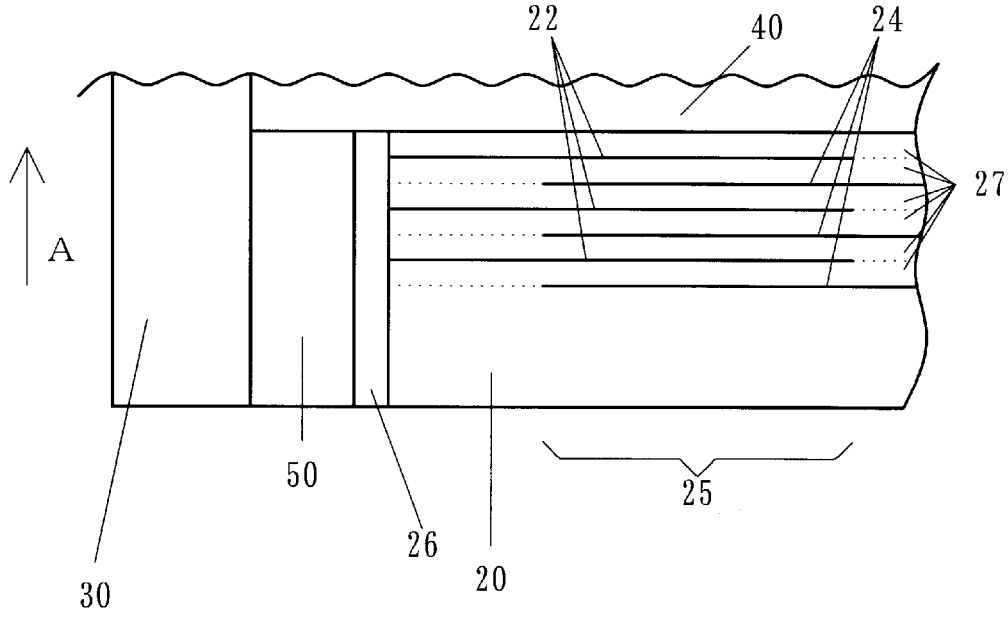
FIG. 5 is a partially enlarged side vide of the inkjet head shown in FIG. 1.
Figure 2:
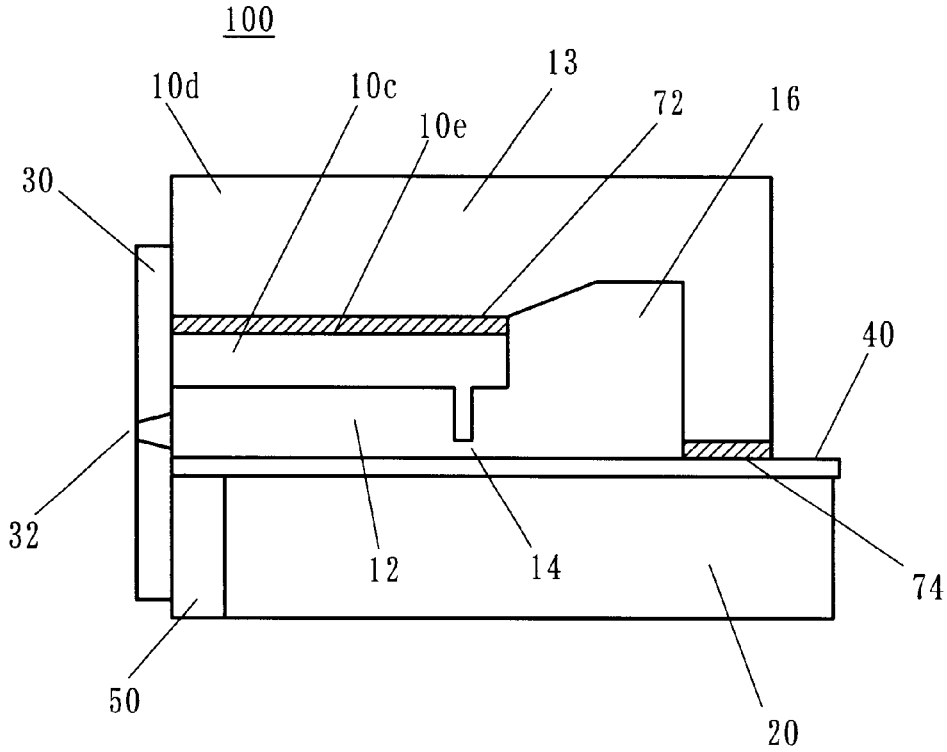
FIG. 2 is a view for explaining a structure of pressure-chamber plate in the inkjet head 100 shown in FIG. 1.
Figure 3:
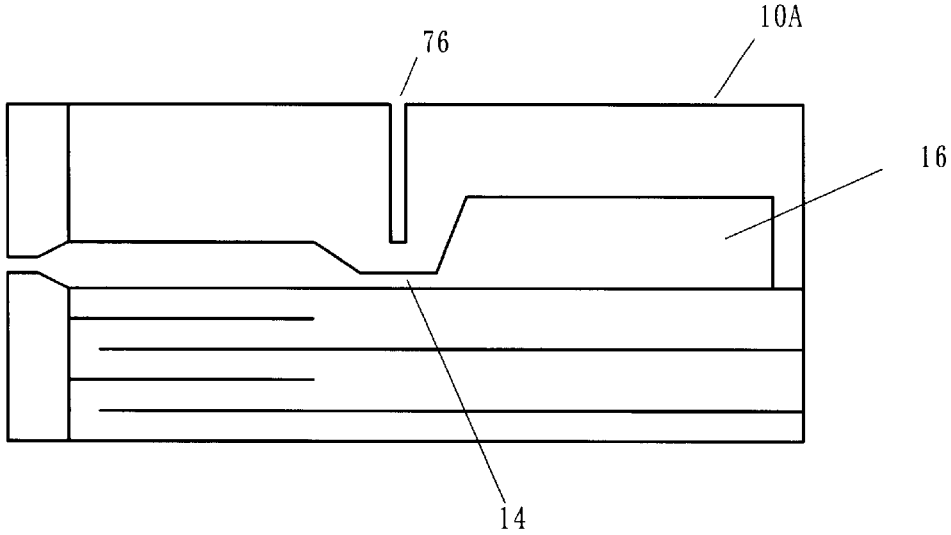
FIG. 3 is sectional view for explaining an alternative embodiment of a structure of the pressure-chamber plate 10 shown in FIG. 2.
Figure 4:
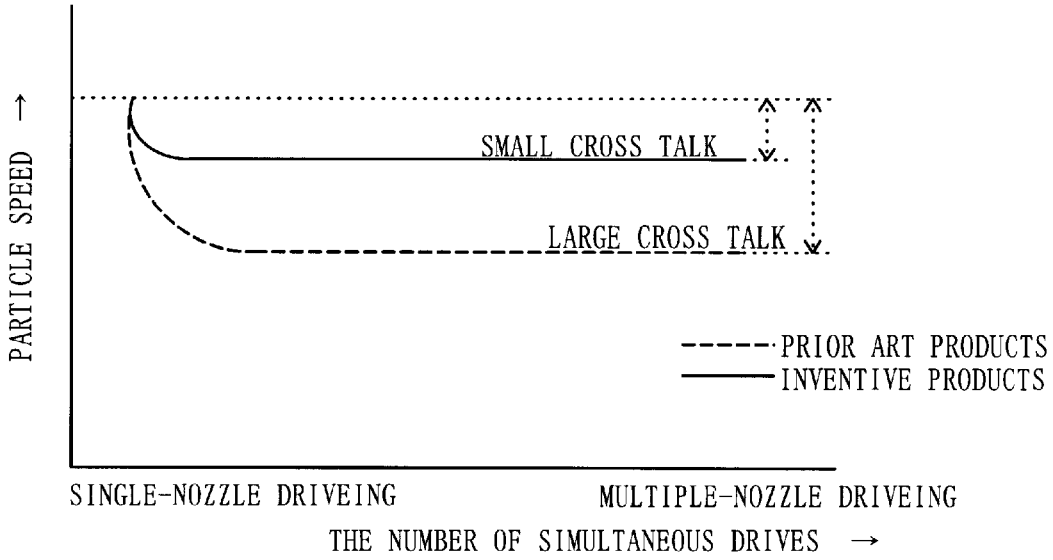
FIG. 4 is a typical graph for explaining characteristic differences between the inkjet head using the pressure-chamber plate shown in FIG. 3 and the conventional inkjet head.

With reference to FIGS. 1–5, a description will now be given of inkjet head 100 and a method for manufacturing the same of a first embodiment of the present invention. Hereupon, FIG. 1 is an exploded perspective view of completed inkjet head 100, and FIG. 2 is a sectional view for explaining a structure of pressure-chamber plate 10 in the inkjet head 100 shown in FIG. 1. FIG. 3 is a sectional view for explaining an alternative embodiment of a structure of the pressure-chamber plate 10 shown in FIG. 2. FIG. 4 is a typical graph for explaining characteristic differences between the inkjet head using the pressure-chamber plate shown in FIG. 3 and the conventional inkjet head. FIG. 5 is a partially enlarged side vide of the inkjet head 100 shown in FIG. 1. As understood by FIG. 1, the inkjet head 100 of the present invention includes pressure-chamber plate 10, piezo-electric element 20, nozzle plate 30 resin film 40, and protective layer 50.

As shown in FIG. 1, the pressure-chamber plate 10, the resin film 40, and the protective layer 50 are aligned with each other at nozzle connection surface 60 which is a surface to which surface 30*a* of the nozzle plate 30 is connected. In other words, front surface 10*a* of the pressure-chamber plate 10, front surface 40*a* of the resin film 40, and front surface 50*a* of the protective layer 50 form the flat nozzle connection surface 60

The pressure-chamber plate 10 has the desired number (four in FIG. 1 for description purposes) of pressure chambers 12 and ink introduction channels 14 and common ink chamber 16 in an approximately rectangular parallelepiped glass plate. In detail, as shown in FIG. 2, the pressure-chamber plate 10 is divided into the elements 10*c* and 10*d*, which are glued and sealed by elastic adhesive 72 at surface 10*e*. The pressure-chamber plate 10 is glued and sealed to the resin film 40 by the elastic adhesive 74.

The elements 10*c* and 10*d* are each made of a high rigid material, such as a glass board. The element 10*c* defines, together with the resin film 40, the pressure chambers 12 and the ink introduction channels 14, whereas the element 10*d* defines the common ink chamber 16 with the resin film 40. Alternatively, the element 10*c* may define the pressure chambers 12 with the resin film 40, whereas the element 10*d* may define the ink introduction channels 14 and the common ink chamber 16. The reason why the element 10*c* is made of a high rigid material is, as described later, to jet ink from the nozzle hole 32 by desirably enhanced pressure in the pressure chambers 12. As far as this condition is met, any material may be used for the element 10*c*.

The elastic adhesives 72 and 74 may employ silicon adhesives, such as, Toshiba Silicon TSE3991 Rubber with hardness of 15° or 19°, Toshiba Silicon TSE 3975 Rubber with hardness of 20°, etc. The elastic adhesive 72 serves to absorb vibration and/or deformation between the elements 10*c* and 10*d*. The elastic adhesive 74 serves to absorb vibration and/or deformation between the element 10*d* and the resin film 40. The elastic adhesives 72 and 74 each have a thickness of about 100 $\mu$m an adhesive bonding strength of about 17 MPa. It is desired to use for the adhesives 72 and 74 an adhesive having an adhesive bonding strength with a MPa order as in this embodiment, because an adhesive having an adhesive bonding strength with a GPa order would be likely to transmit, if used for the adhesives 72 and 74, the vibration and deformation from the pressure chambers 12 to the common ink chamber 16 as described later.

The pressure-chamber plate 10 has been conventionally formed as one unit, undivided into elements 10*c* and 10*d*. Therefore, simultaneous ink jets from the adjacent pressure chambers 12 (i.e., a plurality of nozzle (pins)) would disadvantageously reduce the ink drop speed and the particle amount in comparison with a single nozzle (pin) jetting ink. This phenomenon in which a single ink jet from a single pin is characteristically different than simultaneous jets from a plurality of pins is often called "cross talk".

More specifically, an ink drop speed and particle amount from each nozzle have decreased (for example, by −15 through −20%) since vibration and deformation which occur when a plurality of pins (corresponding to piezo-electric blocks 21 in this embodiment) are simultaneously driven, propagate from the pressure chamber 12 to the common ink chamber 16, and return to the pressure chamber 12. The instant inventors have also found that a channel from a top of the pressure chamber 12 to the common ink chamber 16 via the pressure-chamber plate 10 has greater influence on the propagation of the vibration etc., than a channel from the pressure chamber 12 to the common ink chamber 16 via the ink introduction channel 14. As a result, the multiple-nozzle printing has printing quality (in particular, printed color concentration) worse than the single-nozzle printing, such as, too light color.

On the contrary, this embodiment divides the pressure-chamber plate 10 into the elements 10*c* and 10*d* via the elastic adhesive 72, and prevents vibration and deformation generated in each pressure chamber 12 from propagating to the common ink chamber 16, thereby reducing the cross talk (by around −5% to 0%). The inkjet head 100 of the present invention may thus provide higher printing quality than the conventional.

The elastic adhesive 72 solely is expected to reduce the cross talk to some degree, but it is preferable to combine the adhesive 72 with the adhesive 74 for further cross talk reduction.

It is understood that this embodiment divides the pressure-chamber plate 10 into two elements and cut off a channel at surface 10*e* from a top of the pressure chamber 12 to the common ink chamber 16 via the pressure-chamber plate 10. However, instead of completely dividing the pressure-chamber plate 10 into two or more parts, there are more useful methods for restraining the propagation of deformation and vibration than the conventional. For example, surface 10*a* is slit or grooved at the surface 10*e* toward the inside, reducing the area of the surface 10*e*. In this case, it is preferable not to load adhesive into such a slit. The slit position is notlimited to the surface 10*e*, and the number of slits is not limited to one.

For example, the pressure-chamber plate 10 may be substituted by the pressure-chamber plate 10A having slit 76 on its top as shown in FIG. 3. In FIG. 3, the width of the slit 76 is, for example, about 0 to 170 $\mu$m, and a distance between the bottom of the slit 76 and the ink introduction channel 16 beneath it is, for example, about 300 $\mu$m. The slit 76 is formed in spatially displaced relation from channels formed in the pressure-chamber plate 10 to be said to be "outside" the pressure chamber plate 10. In other words, the slit 76 does not exist between the pressure chamber 12 and the common ink chamber 16 and on a channel through which ink is supplied from the common ink chamber 16 to the pressure chamber 12. Therefore, the slit 76 is not connected to the ink introduction channels 14. Thereby, after ink is jet, the decreased pressure chamber 12 allows ink to be supplied from the common ink chamber 16 for the next jetting. Ink never leaks form the slit 76.

FIG. 4 is a typical graph for explaining characteristic differences between the inkjet head 100A using the pressure-chamber plate 10A shown in FIG. 3 and an inkjet head having an undivided pressure-chamber plate. It is understood by this graph that the inkjet head 100A of the present invention reduces cross talk.

In this way, the elastic adhesives 72 and 74, and the slit 76 each serve as a amper which prevents vibration and/or deformation occurring when the piezo-electric element 20 compresses, as described later, the pressure chamber(s) 12, from propagating to the common ink chamber 16 the damper of this invention need not always be provided along the longitudinal direction of the common ink chamber 16 over a width of each pressure-chamber plate 10. For example, it is provided between the predetermined number (such as, every one or every four) of pressure chambers 12 and the common ink chamber 16. A damper applicable to the present invention may include a vibration-absorbing member for absorbing vibration in the pressure chambers 12 by contacting the pressure-chamber 10. The inner wall in the common ink chamber 16 may install such a vibration-absorbing member or a member having such a different rigidity that prevents deformation.

Each pressure chamber 12 receives and stores ink, and jets the ink from a corresponding nozzle hole 32 which is connected to its opening 12*a* as the internal pressure increases. The internal pressure changes as the piezo-electric block 21 deforms just under the pressure chamber 12, as described later. The pressure chamber 12 is formed as an approximately rectangular parallelepiped space by a concave groove on the pressure-chamber plate 10 and elastically deformable resin film 40.

The common ink chamber 16 supplies ink to each pressure chamber 12 through a corresponding ink introduction channel 14. A bottom of the common ink chamber 16 is defined by the resin film 40 so as to absorb sudden internal-pressure changes, and connected to an ink supply device (not shown) at side 10*b* of the pressure-chamber plate 10. The common ink chamber 16 supplies a necessary amount of ink to the pressure chamber 12 via the ink introduction channel 14 when the chamber 12 returns to the original state after the pressure chamber 12 contracts, receives pressure, and jets ink.

The resin film 40 defines one surface for each of the pressure chambers 12, the common ink chamber 16, and the ink introduction channels 14. The resin film 40 serves to transmit deformation of each piezo-electric block 21 which will be described later to a corresponding pressure chamber 12, and to prevent ink in the pressure chambers 12 from penetrating into the grooves 23 in the piezo-electric element 20. The resin film 40 has a thickness of about 16 $\mu$m and an adhesive bonding strength with an about GPa order, for example. The resin film 40 is a member that forms one surface of the pressure chamber 12, and may be replaced with an elastic metal thin film.

The piezo-electric element 20 has a layered structure having a plurality of (four in FIG. 1 for description purposes) piezo-electric blocks which are divided by parallel grooves 23 which extend from front surface 20*a* to rear surface 20*b*. Internal electrodes 22 and 24 are provided between layers of piezo-electric elements 21. The internal electrodes 22 are connected to external electrode 26, and the internal electrodes 24 are connected external electrode 28. FIG. 1 shows only one external electrode 28 for illustration purposes. The drawings other than FIGS. 1 and 5 omit the internal electrodes 22 and 24 for illustration purposes.

As shown in FIG. 5, active area 25 is a portion where the internal electrodes 22 and 24 overlap each other in direction A, and each piezo-electric block deforms in this active area 25. The length of each active area 25 is adjustable depending upon pressure to be applied to the pressure chamber 12. The active area 25 is spaced from the nozzle connection surface 60 by a predetermined distance, and thus does not affect adhesion between the piezo-electric element 20 and the protective layer 50 at the nozzle connection surface 60.

The external electrode 26 is an electrode layer that is formed on an entire surface of the front surface 20*a* of the piezo-electric element 20 by vacuum evaporation. The external electrode 26 is an external electrode commonly used for all the piezo-electric blocks 21, and grounded. The external electrode 28 is provided on the rear surface 20*b* of the piezo-electric element 20, but is not formed on an entire surface of the rear surface 20*b*. It is an electrode layers that are each independently formed on a portion only corresponding to each piezo-electric block 21. The external electrode 28 has a potential of zero unless electrified, but may apply positive voltage to the internal electrode 24 when electrified.

Due to such a structure, each piezo-electric block 21 of the piezo-electric element 20 does not deform when no voltage is applied to the external electrode 28, since both potentials of the internal electrodes 22 and 24 remain zero. On the other hand, when voltage is applied from the external electrode 28, each piezo-electric block 21 may deform in the direction A (longitudinal direction) in FIG. 1, independent of the other piezo-electric blocks 21. In other words, the direction A is the polarization direction for the piezo-electric elements 21. When the electrification to the external electrode 28 stops, that is, when the piezo-electric element 20 is discharged, the corresponding piezo-electric block 21 returns to the original state.

The piezo-electric element 20 of this embodiment is made, initially by preparing a plurality of green sheets 27. Each green sheet 27 is blended with a solvent, e.g., a ceramic powder solvent, kneaded into paste, and then formed to be a thin film having a thickness of about 50 $\mu$m by a doctor blade.

Among these green sheets, a pattern of the internal electrode 22 is printed and formed onto one surface of each of the three green sheets, the internal electrode 24 is printed and formed onto one surface of each of other three green sheets, and no internal electrode is formed onto the remaining sheets. The internal electrodes 22 and 24 are each printed by blending alloy powder of silver and palladium with a solvent, thereby forming a paste, and applying the paste for pattern formation.

Then, the three sheets including the internal electrode 22 and the three sheets including the internal electrode 24 are alternately stuck together. The remaining six sheets are then stuck together also. Thereby, a layered structure of the piezoelectric element 20 is formed as shown in FIG. 5. In the piezo-electric element 20, the green sheets which include none of the internal electrodes 22 and 24 are formed as a base part.

These layered green sheets are sintered. Then, at least first six green sheets are partially cut off by a diamond cutter from the front surface 20*a* to the rear surface 20*b*, whereby a plurality of piezo-electric blocks 21 are formed and divided by the grooves 23. Lastly, the external electrodes 26 and 28 are formed by the vacuum evaporation at the front surface 20*a* and the rear surface 20*b*. It is possible to form the grooves 23 before sintering.

Characteristic inspection follows for the completed piezo-electric element 20 by applying voltage to the external electrodes 26 and 28, and eliminates poorly operating ones.

The inkjet head 100 shown in FIG. 1 further includes the protective layer 50. The protective layer 50 has useful effects as described later, but it is optional to provide the protective layer 50.

The protective layer 50 is a thermosetting epoxy adhesive member having an approximately rectangular parallelepiped shape with a thickness of about 50 $\mu$m, and connected via surface 50*b* to the front surface 20*a* of the piezo-electric element 20 (external electrode 26). However, a material for the protective layer 50 is not limited to this type. For example, an epoxy system filler, acrylic resin, or polyethylene resin may be used for the protective layer 50. The protective layer 50 in the practical inkjet head 100 does not have a strict rectangular parallelepiped shape, and the connection between the protective layer 50 and the piezo-electric element 20 is not clearly secured by the external electrode 26 and the surface 50, as shown in FIGS. 1 and 5. The protective layer 50 partially penetrates into the grooves 23 in the piezo-electric element 20 before thermosetting. It is therefore preferable that the protective layer 50 is made of insulating materials so as to prevent short-circuiting of the internal electrodes 22 and 24. This embodiment applies the protective layer 50 throughout the front surface 20*a* of the piezo-electric element (external electrode 26), but may partially apply it if necessity arises.

The protective layer 50 spaces the piezo-electric element 20 from the nozzle connection surface 60 by about 50 $\mu$m. Without the protective layer 50, when ink leaks from the pressure chamber 12 and penetrates into the piezo-electric element 20, ink penetrates into the piezo-electric element 20 mainly through the nozzle connection surface 60. However, the protective layer 50 spaces from the nozzle connection surface 60 the piezo-electric element which has been located at the nozzle connection surface 60, and prevents the ink from penetrating into the piezo-electric element 20 and short-circuiting the internal electrode 22 and 24.

The protective layer 50 shields the grooves 23. Without the protective layer 50, when ink leaks and penetrates into the piezo-electric element 20, the ink penetrates into the piezo-electric element 20 mainly from the grooves 23 through the nozzle connection surface 60 from the opening 12*a* of the pressure chamber 12. However, the protective layer 50 shields the grooves 23 from the nozzle connection surface 60 (i.e., viewed from the nozzle connection surface 60), preventing ink from penetrating into the grooves 23 near the front surface 20*a* of the piezo-electric element 20 and from short-circuiting the internal electrodes 22 and 24.

Moreover, the protective layer 50 protects the piezo-electric element 20 from getting damaged by polishing during the polishing process for forming the front surface 20*a* in the inkjet head manufacturing process. As a result, the polishing step neither causes exfoliation, crack, and chip-off in the piezo-electric element 20, nor omits the external electrode 26. Since the pressure-chamber plate 10 is made of glass and thus relatively strong, the protective layer 50 enables the polishing speed to be higher than the manufacturing method which does not use the protective layer 50, thereby reducing the polishing time to about one-fifth.

The nozzle plate 30 is formed by metal, such as stainless. A pin using a punch processes each nozzle hole 32 into a conical shape (sectionally taper shape) which preferably spreads from the front surface 30*b* to the rear surface 30*a* in the nozzle plate 30. Obtaining such conical shaped nozzle hole 32 is one of the reasons why the pressure-chamber plate 10 and the nozzle plate 30 are not formed as one unit but the pressure-chamber plate 10 is adhered to the nozzle plate 30. In this embodiment, the nozzle hole 32 at the rear surface 30*a* has a size of about 80 $\mu$m, and the nozzle hole 32 at the front surface 30*b* has a size of about 25 to 35 $\mu$m. In addition to the inkjet head 100, the present invention is applicable to an inkjet head in which nozzle holes are formed at the top of the pressure-chamber plate 10.

Figure 9:
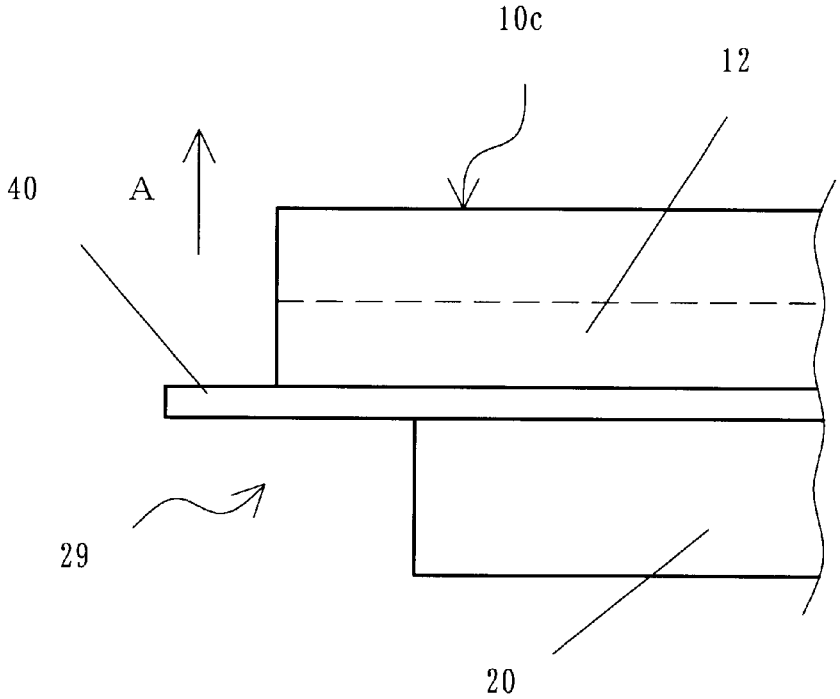
FIG. 9 is a sectional view for explaining another step in the flowchart shown in FIG. 7.

In the inkjet head 100, each external electrode 28 independently applies voltage to the internal electrode 24 of the piezo-electric block 21, and each piezo-electric block 21 independently deforms in the direction A in FIG. 9, bending the resin film 40 in the direction A and compressing corresponding pressure chamber 12. This compression results in jetting ink from the pressure chamber 12 through corresponding nozzle hole 32. After electrification from the external electrode 28 stops, the resin film 40 and the piezo-electric block 21 return to the original states by discharging. At that time, the internal pressure of the pressure chamber 12 decreases and ink is supplied from the common ink chamber 16 to the pressure chamber 12 through the ink introduction channel 14.

Although the instant embodiment uses the piezo-electric element 20 which may longitudinally deform in the direction A, the present invention is applicable to those which may laterally deform. In addition, the present invention is not limited to so-called piezo-type using a piezo-electric element, but is applicable to bubble-type inkjets.

Figure 7:
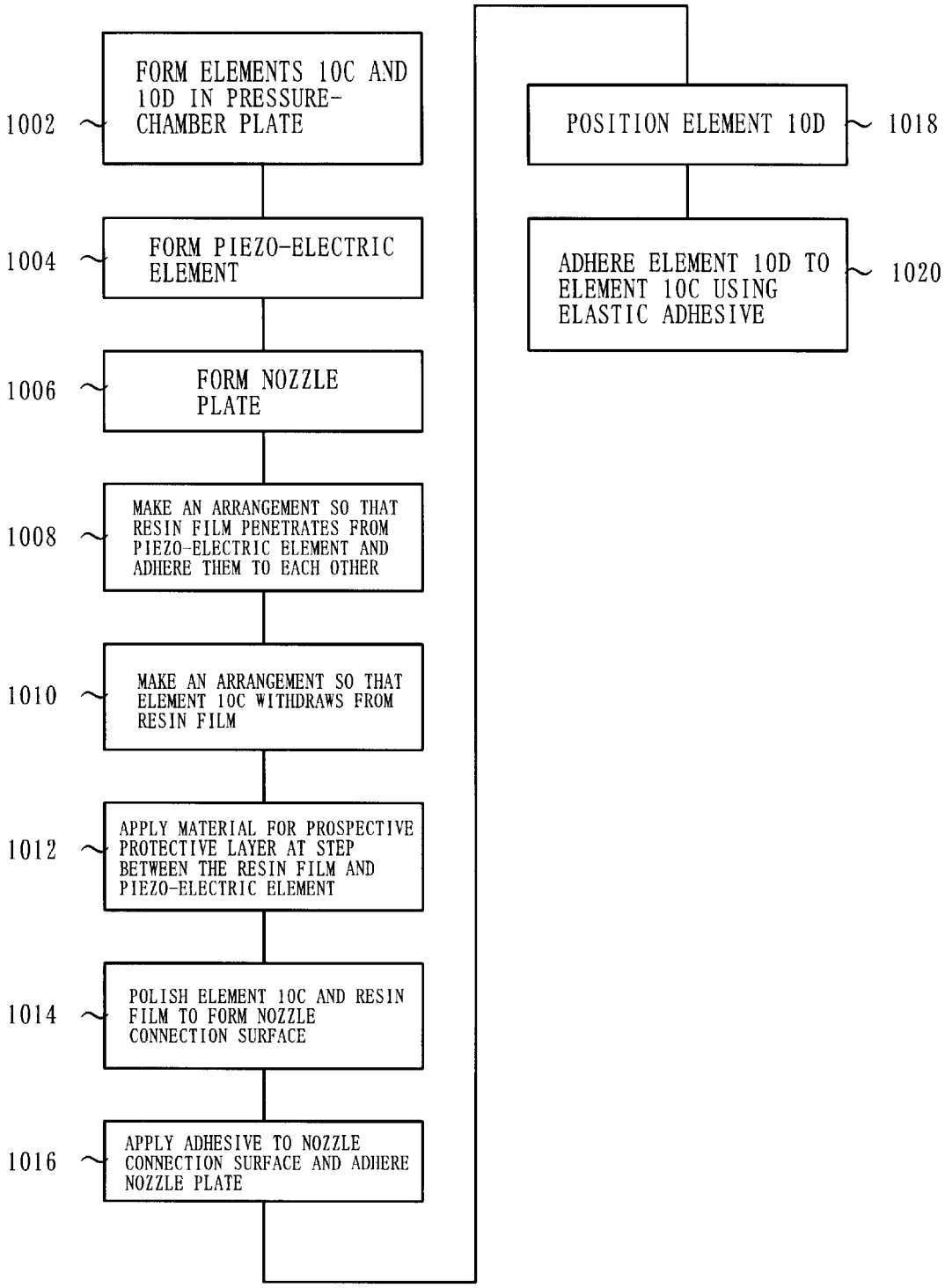
FIG. 7 is a flowchart for explaining an exemplified manufacturing method of the inkjet head shown in FIG. 2.

Next follows an exemplified manufacturing method, especially a fabrication method, of the inkjet head 100 shown in FIG. 2 with reference to FIGS. 7 through 10. FIG. 7 is a flowchart for explaining an exemplified manufacturing method of the inkjet head 100 shown in FIG. 2. FIGS. 8 through 12 are sectional views for explaining steps shown in FIG. 7, but each component size is somewhat exaggerated for description and illustration purposes in each drawing. First, the elements 10*c* and 10*d* as components of pressure-chamber plate 10 are independently formed as described above (step 1002). In addition, the piezo-electric element 20 and the nozzle plate 30 may be formed as described above (steps 1004 and 1006). Any step among these steps 1002 through 1006 may be conducted prior or subsequent to other steps.

Figure 8:
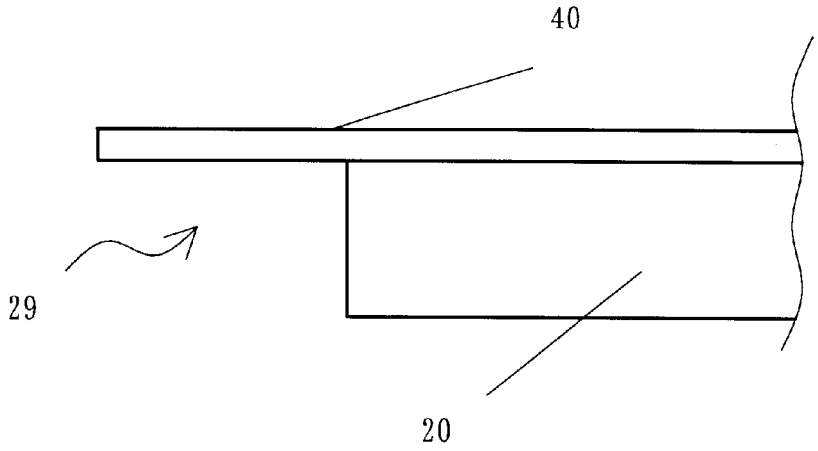
FIG. 8 is a sectional view for explaining one step in the flowchart shown in FIG. 7.

As shown in FIG. 8, the arrangement of the resin film 40 and the piezo-electric element 20 is determined so that the resin film 40 protrudes by about 500 $\mu$m toward the nozzle plate 30 from the piezo-electric element 20 that has been confirmed to work properly. Then, they are adhered to each other (step 1008). Such an arrangement forms step 29 onto which the protective layer 50 is to be applied in order to protect the piezo-electric element 20. The adhesive may employ, for example, urethane system adhesives, acrylic system adhesives, resist films and the like.

As shown in FIG. 9, the element 10*c* of the pressure-chamber plate 10 is arranged and adhered at the side opposite to the piezo-electric element 20 so that the element 10*c* withdraws by about 300 μm toward the nozzle plate 30 from the resin film 40, and protrudes by about 200 μm toward the nozzle plate 30 from the piezo-electric element 20 (step 1010). Before the element 10*c* of the pressure-chamber plate 10 is adhered to the resin film 40, a positioning is conducted so that each piezo-electric block 21 corresponds to the pressure chamber 12. Here, it is conceivable to arrange, instead of the element 10*c*, the pressure-chamber plate 10 which is made by adhering the element 10*c* to the element 10*d*, but the step 1010 is better by the following reasons than such a manner. The adhesive may employ, for example, urethane system adhesives, acrylic system adhesives, resist films and the like.

This embodiment conducts the adhesion of the piezo-electric element 20 to the resin film 40 prior to the adhesion of the resin film 40 to the pressure-chamber plate 10. However, it is understood that the present invention covers a case where the step 105 is conducted prior to the step 104.

In this embodiment, the pressure-chamber plate 10 is arranged so that the pressure-chamber plate 10 withdraws from the resin film 40 toward the nozzle plate 30. This is to prevent the protective layer 50 from penetrating into the pressure chamber 12 from the opening 12*a* and close the opening 12*a* of the pressure chamber 12, when the protective layer 50 is applied to the step 29 as described later. Alternatively, the present invention may prevent the protective layer 50 from penetrating into the pressure chamber 12 by arranging a proper mask over the pressure-chamber plate 10 which protrudes from the resin film 40 (in particular, a surface opposite to the resin film 40), before the protective layer 50 is applied. In this case, a protrusion of the element 10*c* from the resin film 40 toward the nozzle 30 does not pose a problem. The element 10*c* is arranged so that the element 10*c* protrudes from the piezo-electric element 20 toward the nozzle plate 30. This is to prevent the piezo-electric element 20 from being polished in the following polishing 1014.

In an attempt to prepare a three-layer structure shown in FIG. 9 composed of the element 10*c*, the resin film 40, and the piezo-electric element 20, the preparation becomes easier if the direction A is orientated to the gravity direction. The resin film 40 protrudes in the three-layer structure in FIG. 9, and seemingly tends to bend toward the element 10*c* by the gravity action. However, the three-layer structure shown in FIG. 9 can be maintained by using the surface tension of the resin film 40. It is not an absolute requirement that the gravity direction necessarily accords with the direction A.

Figure 10:
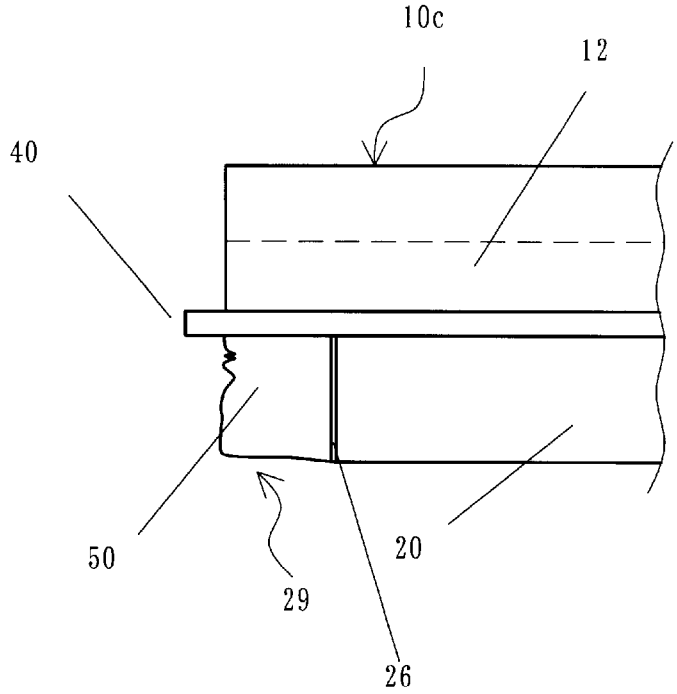
FIG. 10 is a sectional view for explaining another step in the flowchart shown in FIG. 7.

Next, as shown in FIG. 10, a material is applied to the step 29 for the prospective protective layer 50 between the resin film 40 and the piezo-electric element 20 (step 1012). The protective later 50 uses a thermosetting epoxy system adhesive in this embodiment, and is thermally hardened after applied. The protective layer 50 has a relatively low viscosity, and partially penetrates into the piezo-electric element 20 from the grooves 23 when applied to the step 29. The protective layer 50 thermally hardens while sealing part of the grooves 23. It is possible to exchange the step 1012 with the step 1010, whereby the protective layer 50 is applied first and then the element 10*c* is adhered. Unlike this embodiment which applies the protective layer 50 throughout the front surface 20*a* of the piezo-electric element 20 (external electrode 26), the protective layer 50 may be partially applied if necessity arises.

Figure 11:
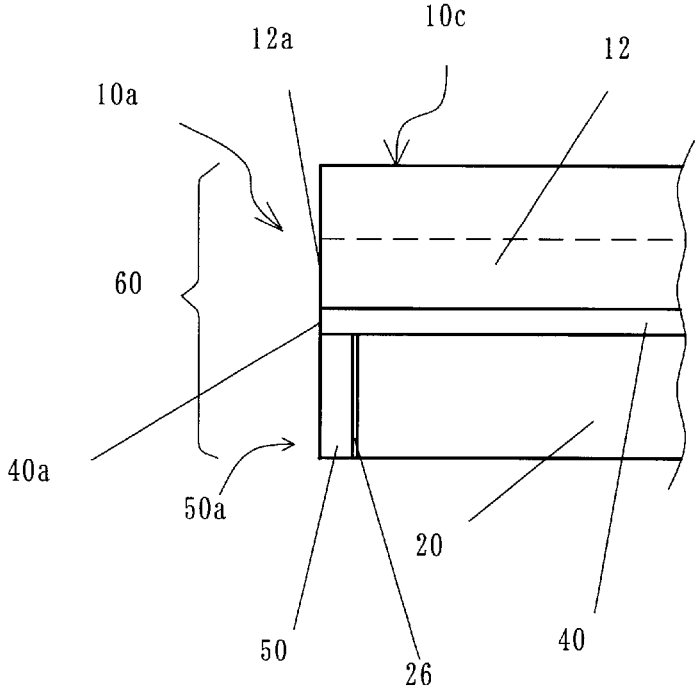
FIG. 11 is a sectional view for explaining another step in the flowchart shown in FIG. 7.

Next, the flat nozzle connection surface 60 is formed by polishing the edge of the element 10*c*, the resin film 40, and the protective layer 50 (step 1014). FIG. 11 shows the nozzle connection surface 60 after the polishing. This polishing step is a necessary step to precisely connect each nozzle hole 32 of the nozzle plate 30 to the pressure chamber 12 and firmly secure the nozzle plate 30 onto the element 10*c* and other elements. The polishing leaves a thickness of about 50 μm of protective layer 50, cutting off the element 10*c* by 150 μm.

In this polishing step, the piezo-electric element 20 is protected by the protective layer 50 and thus not affected by the polishing. Therefore, the polishing process does not cause any exfoliation, crack, and chip-off to the piezo-electric element 20. The external electrode 26 is never cut off. In addition, the element 10*c* is made of glass and relatively strong enough to endure a high polishing speed. Thus, the manufacturing method of the present invention shortens the polishing time down to about one-fifth in comparison with the conventional manufacturing method.

In the step 1010 as described above, it is conceivable to arrange, instead of the element 10*c*, the pressure-chamber plate 10 which is made by adhering the element 10*c* to the element 10*d*. In this case, the element 10*d* adhered to the element 10*c* by the elastic adhesive 72 is polished. However, this would cause cracking of the elastic adhesive 72 between the elements 10*c* and 10*d*, and the elasticity of the elastic adhesive 72 creates roughness of the nozzle connection surface 60 due to vibration of the elements 10*c* and/or 10*d* during the polishing process. On the other hand, the polishing step is requisite to form the flat nozzle connection surface 60 to avoid the element 10*d* projecting from the element 10*c* toward the nozzle plate 30 and getting adhered to the element 10*c*. Therefore, it is preferable to adhere only the element 10*c* in the step 1010 except for a case where the elements 10*c* and 10*d* may be adhered to each other so as to form a flat surface without polishing. If the elements 10*c* and 10*d* may form a flat surface, only the resin film 40 and the protective layer 50 will be polished at the step 1014, so as to form the nozzle connection surface 60 with the elements 10*c* and 10*d*.

Figure 12:
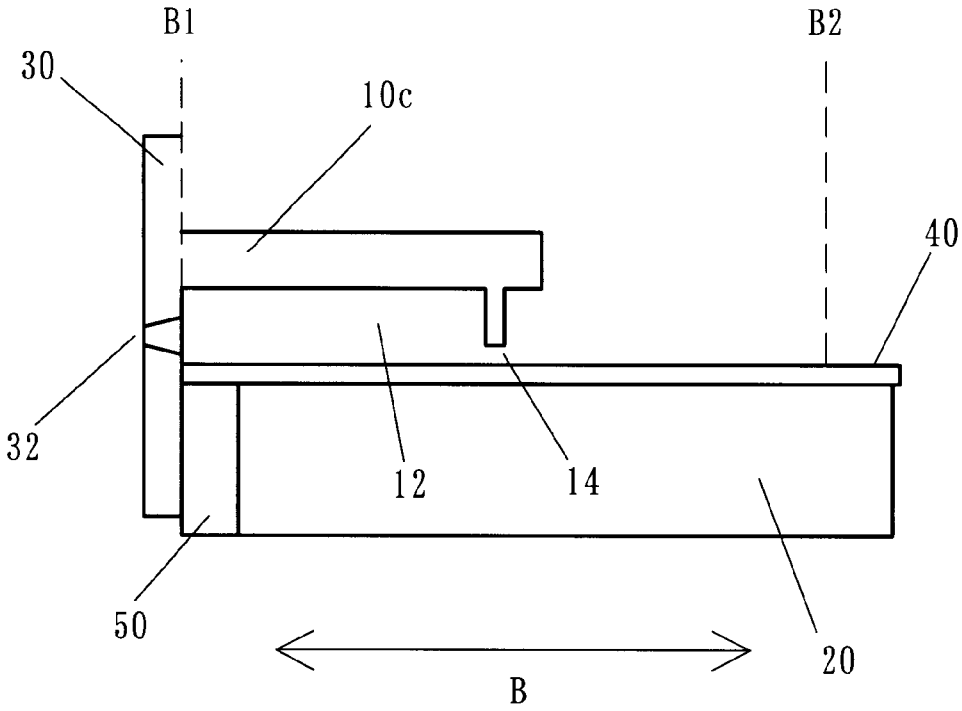
FIG. 12 is a sectional view for explaining another step in the flowchart shown in FIG. 7.

When the polishing ends, as shown in FIG. 12, the adhesive is applied onto the nozzle connection surface 60 by about 3 to 4 μm, whereby the nozzle plate 30 is adhered to the nozzle connection surface 60 so that the nozzle holes 32 correspond to the pressure chambers 12 (step 1016). The adhesive may employ, for example, urethane system adhesives, acrylic system adhesives, resist films and the like. An area sufficient to fix the nozzle plate 30 is selected on a surface which forms the nozzle connection surface 60 of the element 10*c*.

Next, a positioning of the element 10*d* is conducted (step 1018), and then the element 10*d* is adhered to the element 10*c* by the elastic adhesive 72 (step 1020). The application of the elastic adhesive 72 may be prior or subsequent to the step 1018. In step 1020, the element 10*d* is adhered to the resin film 40 via the elastic adhesive 74.

The manufacturing method of this embodiment preferably adheres the element 10*d* to the element 10*c* after the element 10*d* is positioned. Although the present invention broadly covers those embodiments which omit the step 1018, the elements 10*d* and 10*c* define the common ink chamber 16 in such embodiments and a positional shift of the element 10*d* has a risk of ink leakage from the common ink chamber 16. Such embodiments includes, for example, a case where the elastic adhesive 72 is applied to the surface 10*e* on the element 10*c* and the element 10*d* is placed on the element 10*c* at its top using operator's eyes. On the other hand, the instant embodiment may prevent ink leakage from the common ink chamber 16 since the adhesion is conducted after the element 10*d* is positioned.

In this embodiment, the elastic adhesive 72 has been uniformly applied on the top surface 10*e* of the element 10*c*, and the front surface B1 and the rear surface B2 shown in FIG. 12 are fixed by known appropriate means in the art to position the element 10*d* (in this case, only in the direction B though). Then, the element 10*d* may be adhered to the element 10*c* by inserting the element 10*d* in an arrow direction shown in FIG. 12. Hereupon, a distance between the surfaces B1 and B2 approximately corresponds to a length of the element 10*d*.

The instant embodiment does not absolutely require a direct adhesion of the element 10*d* onto the nozzle plate 30. As described above, an area sufficient to fix the nozzle plate 30 is selected for a surface that forms the nozzle connection surface 60 in the element 10*c* and the element 10*d* is stably adhered to the element 10*c* at its surface 10*e*. The present invention does not prevent adhesion between the element 10*d* and the nozzle plate 30. As shown in FIG. 12, when the element 10*d* protrudes from the nozzle plate 30, it is desired to apply adhesive to the side of the nozzle plate 30. In particular, when properly positioned, the element 10*d* may constitute part of the nozzle connection surface 60 or is located very close to it. Thus, when it is adhered to the nozzle plate 30, the element 10*d* does not apply undesired stress to the nozzle plate 30. For example, the element 10*d* placed in the right direction beyond the surface B2 shown in FIG. 12 unless positioned, becomes spaced from the nozzle plate 30. In this state, when the nozzle plate 30 is adhered to the element 10*d*, the stress in the right direction is applied to the top of the nozzle plate 30. Since the nozzle plate 30 has predetermined rigidity, such a stress may cause a disconnection of the nozzle plate 30.

Figure 13:
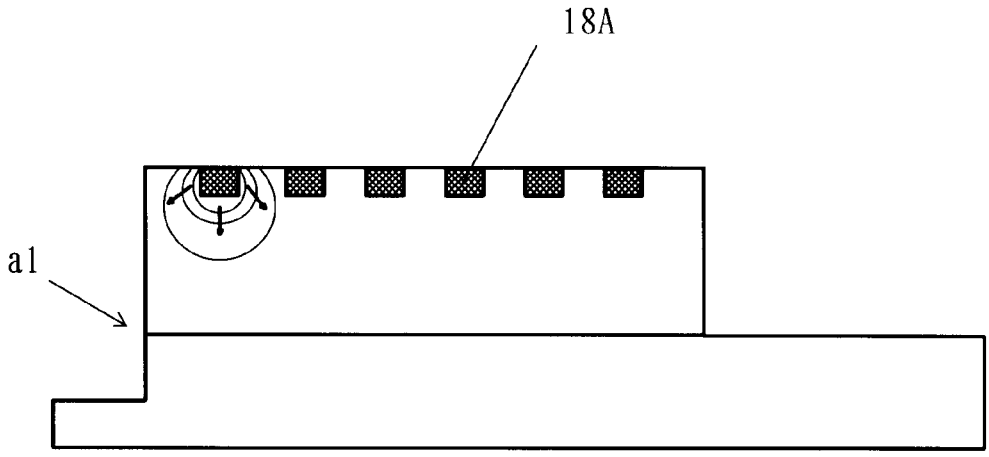
FIG. 13 is an exemplified schematic top view of element 10*d* in the pressure-chamber plate in the inkjet head shown in FIG. 2.
Figure 14:
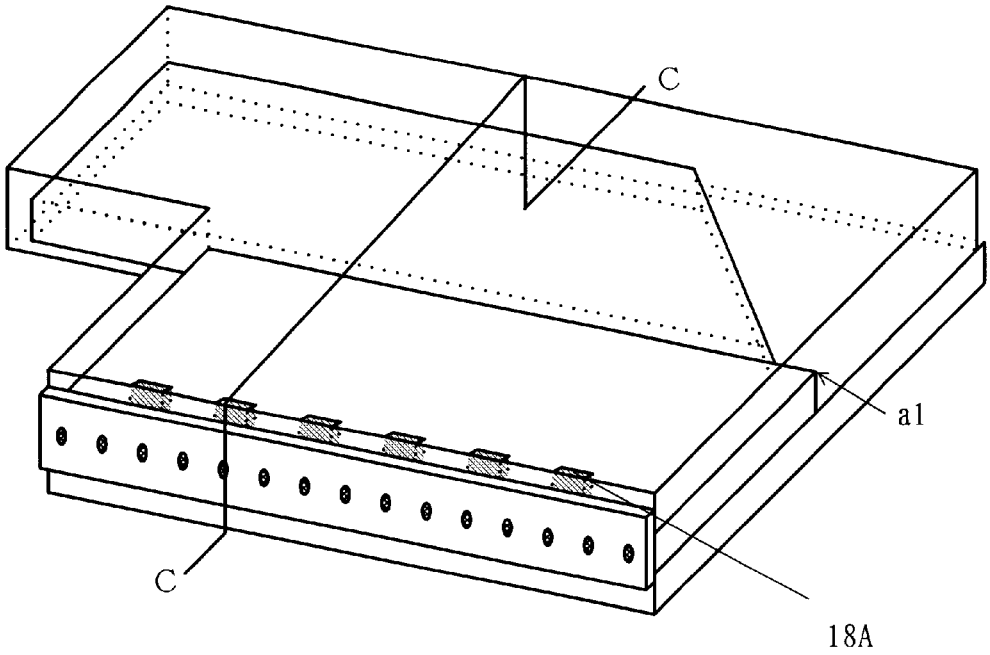
FIG. 14 is a schematic perspective view of an inkjet head having the element 10*d* shown in FIG. 13
Figure 15:
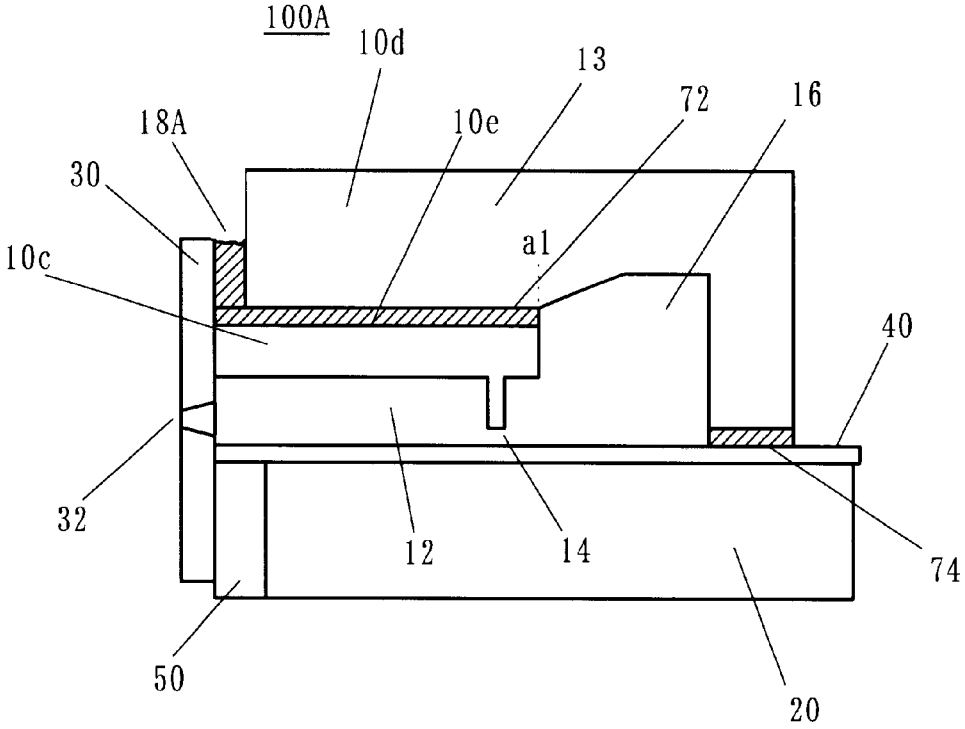
FIG 15 is a schematic sectional view of FIG. 14 taken along line C—C.

With reference to FIGS. 13 through 15, a description will now be given of alternative positioning and adhesion methods to the above steps 1018 and 1020. In the above steps, the element 10*d* is adhered after the elastic adhesive 72 is applied to the top surface 10*e* of the element 10*c* by appropriate means (such as, a manual operation using a brush and a spray, and an automatic process using machine). The instant inventors have found that such a method is hard to control of the application amount of the elastic adhesive 72, causing an inconsistent application throughout the top surface 10*e*, and an inevitable mixture of air during the adhesion of the adhesive 72. Uneven application of the adhesive 72 and air mixed surface 10*e* results in the adhesive 72 leaking to the side of the common ink chamber 16 and closing part or all of the ink introduction channels 14, or air entering the common ink chamber 16 and/or pressure chamber 12 and changing the pressure in the pressure chamber 12. The adhesive 72 closes part or all of ink introduction channels 14, changing the ink amount to be jet from the nozzle plate 30 (or blocking ink to jet), and lowering the printing quality (for example, too light printed color). The pressure chamber 12 which partially loads air instead of ink would change, when compressed, the jet ink amount and lower the printing quality. Accordingly, those methods which will be described in the following embodiment have an exemplified object to facilitate even and uniform applications of the adhesive 72 onto the top surface 10*e* and control the application amount, thereby realizing the high quality printing.

In order to achieve the above object, the instant inventors have devised perforation hole 18A to pour the elastic adhesive 72 into one of the elements 10*d* and 10*c*, whereby the poured adhesive 72 seals the surface 10*e* and adheres the element 10*d* to the element 10*c*. FIGS. 13 to 15 show an embodiment of method for installing the perforation hole 18A. In this embodiment, the perforation hole 18A is provided into the element 10*d* which constitutes the pressure-chamber plate 10, while FIG. 13 is an approximately top view of the element 10*d* having the perforation holes 18. As shown in FIG. 13, the rectangular shaped perforation holes 18A contact the surface B1 shown in FIG. 12, and are aligned with each other at the same interval. Each perforation hole 18A extends perpendicular to a top surface of the element 10*d*, and has a rectangular shape. The desired number (e.g., six in this embodiment for illustration purposes) of perforation holes 18A may be provided, and its shape and size are also variable. The elastic adhesive 72 poured into these perforation holes 18, adheres and seals the aperture between the elements 10*d* and 10*c* using a capillary action as shown by arrows in FIG. 13. At this time, it is desirable that the adhesive 72 is poured into interface al between the element 10*c* and the common ink chamber 16.

FIG. 14 is a schematic perspective view of the inkjet head 100 in which the element 10*d* has perforation holes 18A in FIG. 13. As shown in FIG. 14, these perforation holes 18A are provided at the side opposite to the common ink chamber 16 and at the adhesion surface (surface B1 shown in FIG. 12) of the element 10*d* with the nozzle plate 30. The element 10*d* in this embodiment therefore includes a non-contact area with the nozzle plate 30 due to the perforation holes 18A, but they are stably fixed to each other by the sufficient adhesion area between the element 10*d* and the nozzle plate 30 as described above. In this embodiment, the element 10*d* is assembled, irrespective of the existence of the perforation holes 18A, in accordance with the flowchart in FIG. 7 except for an additional step between the steps 1018 and 1020 for pouring the elastic adhesive 72 into the perforation holes 18A.

Such a step will be discussed in detail with reference to FIG. 15. Hereupon, FIG. 15 is a schematic sectional view of the inkjet head 100 in FIG. 14 taken along line C—C. Each perforation hole 18A contacts the nozzle plate 30, and receives the poured adhesive 72, thereby adhering and sealing the aperture between the elements 10*c* and 10*d*. At this time, at least the same amount of adhesive 72 is needed for a space volume made by the elements 10*c* and 10*d*. As an adhesive hardens its volume decreases in general. It is therefore necessary to consider a nature of usable adhesives.

Figure 16:
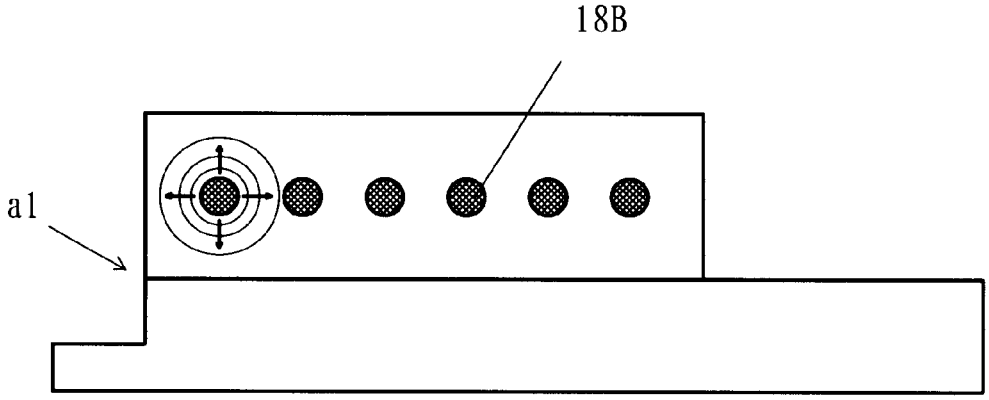
FIG. 16 is another exemplified schematic top view of the element 10*d* in the pressure-chamber plate in the inkjet head shown in FIG. 2.
Figure 17:
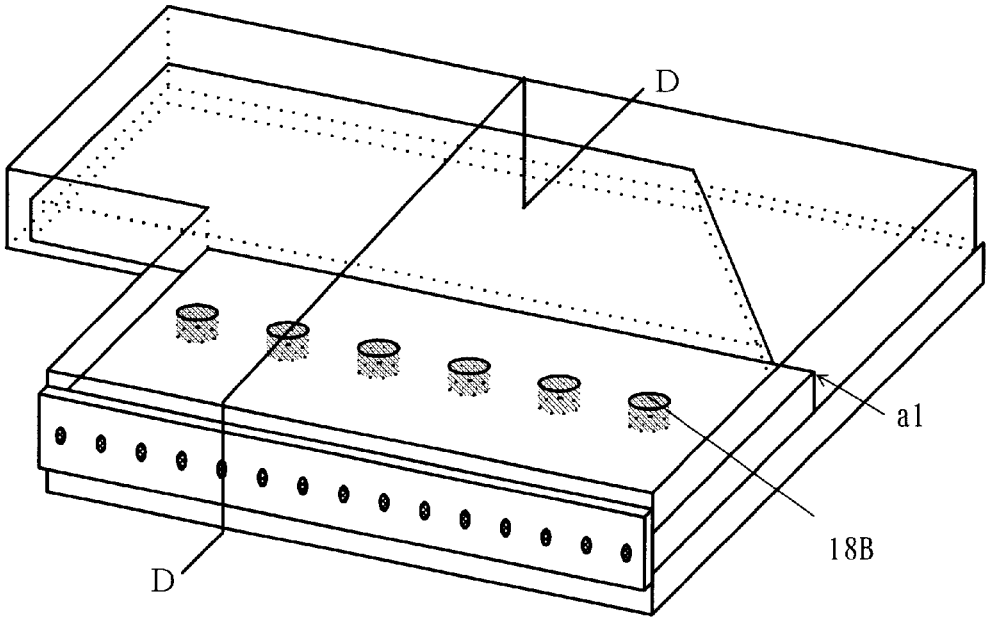
FIG. 17 is a scematic perspective view of an inkjet head having the element 10*d* shown in FIG. 16.
Figure 18:
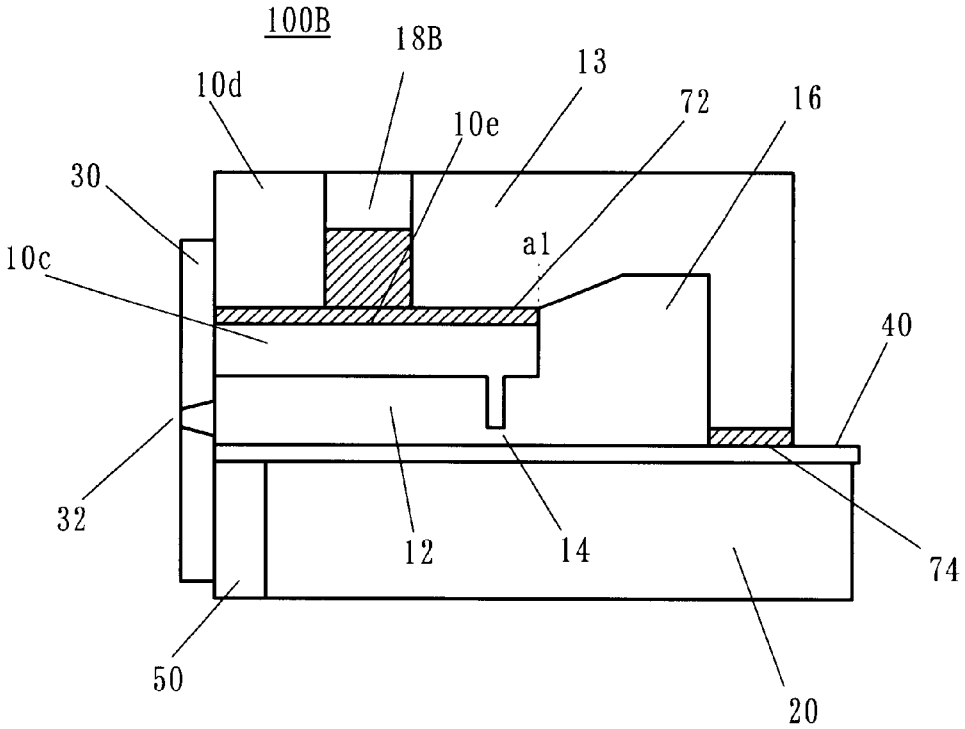
FIG. 18 is a schematic sectional view of FIG. 17 taken along line D—D.

FIGS. 16 through 18 relate to an alternative installing embodiment to that of the perforation hole 18A. The above step of pouring the elastic adhesive 72 in the inkjet head 100A from its top with difficulty, often resulting in spilling the adhesive over the top of the nozzle plate 30. In addition, the adhesive 72 should be poured into the interface al between the element 10*c* and the common ink chamber 16 in order to completely seal the aperture between the elements 10*c* and 10*d*, but the long pouring distance to the common ink chamber 16 hardens the adhesive 72 on its way or allows the adhesive 72 to be enter the common ink chamber 16. The adhesive 72 does not propagate to the top, down, left and right uniformly by a capillary action since each perforation hole 18A has a rectangular shape as shown in FIG. 13.

The instant embodiment provides the perforation holes 18B with the element 10*d*. FIG. 16 is a schematic top view of the element 10*d* having the perforation holes 18B. The perforation holes 18B each have a cylindrical shape, and six perforation holes 18 are aligned with each other in parallel and at a regular interval. Each perforation hole 18B extends above an approximately center of the element 10*c*, and perforates the element 10*d* perpendicular to its top surface. As shown by an arrow in FIG. 16, the adhesive 72 poured into the perforation hole 18B adheres and seals the aperture between the element. 10*c* and 10*d* by the capillary action.

FIG. 17 is a schematic perspective view of the inkjet head 100B. The perforation holes 18B are aligned with the center line between the surfaces B1 and a1. The inkjet head having the element 10*d* in this embodiment is also manufactured by the flowchart shown in FIG. 7 except for an additional step after the step 1018 of pouring the elastic adhesive 72 into the perforation hole 18B, adhering the elements 10*c* and 10*d* and sealing the aperture between them (step 1020). A more detailed description of the injection step of the adhesive 72 will be give with reference to FIG. 18.

FIG. 18 is a schematic sectional view of the inkjet head 100B in FIG. 17 taken along line D—D. As shown in FIG. 18, the perforation holes 18B are located at portions which are desired to be sealed by adhesive, that is, at approximately central positions between the nozzle plate adhesion surface 30*a* (i.e., surface B1 in FIG. 12) and the interface al with the common ink chamber. The adhesive 72 poured into the perforation hole 18B fills the aperture between the elements 10*c* and 10*d* by the capillary action. As each perforation hole 18B is circular and located in position the adhesive 72 flows through a space between the elements at regular interval around the perforation hole 18B. The adhesive 72 poured into the perforation hole 18B may thus proceed at the same speed to the left and right in FIG. 18, with shorter filling time (than those in the above embodiments), preventing the hardening and uneven adhesive application during the pouring process. The amount of adhesive 72 is controllable by calculating a space volume between the elements. This eliminates such a problem of a variable ink jet amount from each nozzle hole 32 as is caused by air mixture by the uneven seal and the adhesive 72 leaking to the ink chamber 16 and closing part or all of the ink introduction channel 14 or changing the pressure in the ink chamber 16. As a result, the inkjet head 100B may prevent deteriorated printing quality in this embodiment.

Unlike the perforation holes 18A and 18B in the above embodiments, the perforation holes 18A and 18B may be provided with the element 10c. However, when the perforation holes 18A and 18B (referred to as collectively "18" hereinafter) are provided with the element 10*c*, the manufacturing steps of the inkjet head 100A and 100B (referred to as collectively "100" hereinafter) is different from the flowchart in FIG. 7. The element 10*c* is adhered to the resin film 40 in the step previous to the step of adhering the nozzle plate 30 in the flowchart in FIG. 7 (see step 1010). However, the bottom surface of the perforation hole 18 is sealed in the step 1010, and the adhesion to the element 10*d* may not use the perforation holes 18. Therefore, in order to adhere and seal the elements 10*c* and 10*d* using the perforation holes 18, it is conceivable to arrange the pressure-chamber plate 10 which is made by adhering the elements 10*c* and 10*d*, instead of the element 10*c* in the step 1010. Nevertheless, in this case, as described above, the polishing process (step 1014) damages the adhesion layer. This polishing process would prevent formation of the flat nozzle adhesion surface 60 and an accurate adhesion with the nozzle plate 30, causing the low printing ability. Therefore, the provision of the perforation holes 18 with the element 10c requires smoothness without polishing the element 10*c* and 10*d*.

As described above, the pressure-chamber plate 10 is divided into a plurality of elements, and the elastic adhesion 72 adheres and seals the apertures among these elements, reducing or eliminating propagation of vibration or deformation generated in the pressure chamber 12 to the common ink chamber 16. The pressure-chamber plate 10 is divided into two elements in the above embodiments, but as the number of divided elements increases an effect of preventing or reducing propagation of pressure increases. In particular, if the adhesion among elements is easy as described above, it is effective in the manufacturing process. The inkjet head 100 of the present invention may provide the higher printing quality than the conventional.

Figure 6:
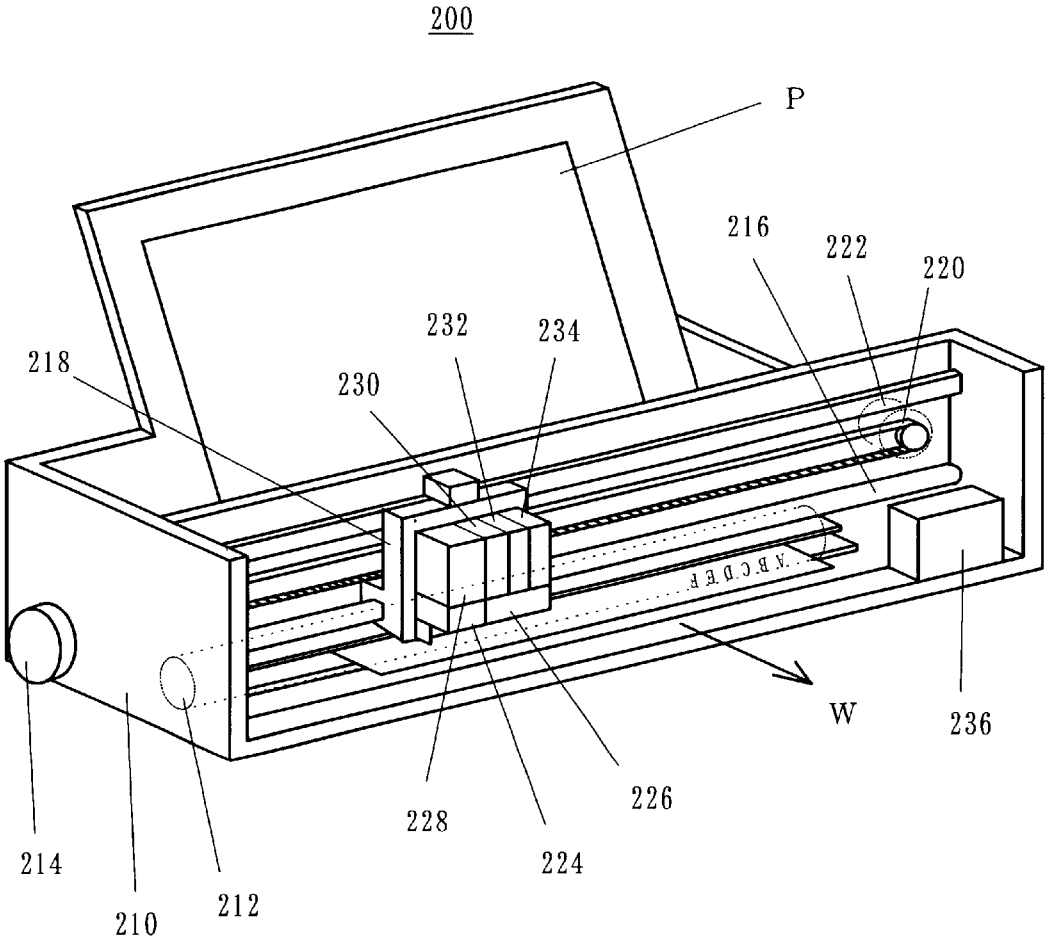
FIG. 6 is a schematic perspective view of the inkjet printer using the inkjet head shown in FIG. 1.

With reference to FIG. 6, a description will be given of inkjet printer 200 having the inkjet head 100. The same reference numeral in each drawing designates the same element, and thus a description thereof will be omitted.

FIG. 6 shows a schematic embodiment of the color inkjet printer (recording device) 200 to which the inkjet head 100 of the present invention is applicable. Platen 212 is pivotally provided in housing 210 in the recording device 200. During the recording operation, the platen 212 is intermittently driven and rotated by drive motor 214, thereby intermittently feeding recording paper P by a predetermined pitch in direction W. Guide rod 216 is provided above and parallel to the platen 212 in the recording device housing 210, and the carriage 218 is provided in a slidable manner above the guide rod 216.

The carriage 218 is attached to end-free drive belt 220, while the end-free drive belt 220 is driven by the drive motor 222. Thereby, the carriage 218 reciprocates (scans) along the platen 212.

The carriage 218 includes recording head 224 for monochromatic (i.e., black-color) printing and recording head 226 for multicolor printing. The recording head 226 for multicolor printing may include three components. The recording head 224 for monochromatic printing detachably includes black color ink tank 228, while the recording head 226 for multicolor printing detachably includes color ink tanks 230, 232 and 234.

The black color ink tank 228 accommodates black color ink, while the color ink tanks 230, 232 and 234 respectively accommodate yellow ink, cyan ink, and magenta ink.

While the carriage 218 reciprocates along the platen 212, the recording head 224 for monochromatic printing and the recording head 226 for multicolor printing are driven in accordance with image data provided from the word processor, personal computer, etc., thereby recording predetermined letters and images on the recording paper P. When the recording operation stops, the carriage 218 returns to a home position where a nozzle maintenance mechanism (i.e., a back-up unit) 236 is provided.

The nozzle maintenance mechanism 236 includes a movable suction cap (not shown) and a suction pump (not shown) connected to this movable suction cap. The recording heads 224 and 226 are each positioned at the home position, the suction cap is adhered to the nozzle plate 30 in each recording head and absorbs nozzle in the nozzle plate 30 by driving the suction pump, so as to prevent any clog in the nozzle.

Further, the present invention is not limited to these preferred embodiments, but various variations and modifications may be made without departing from the scope of the present invention.

As described above, the present invention reduces vibration and deformation of the pressure chamber propagating to the ink chamber when the pressure chamber is pressurized, preventing an ink drop amount and speed from changing and deteriorating the printing quality. In particular, the pressure-chamber plate having a plurality of pressure chambers may prevent cross talk. The present invention may achieve the above effects easily and inexpensively because the pressure-chamber plate needs merely to be cut or severed.

What is claimed is:

1. An inkjet head comprising:

a pressure-chamber plate which defines a pressure chamber for storing ink, and an ink chamber for supplying the ink to the pressure chamber, said pressure-chamber plate including a slit outside a channel between the pressure chamber and the ink chamber, said slit dividing said pressure-chamber plate into two parts, one of which defines said pressure chamber and the other of which defines said ink chamber, said channel supplying the ink from the ink chamber to the pressure chamber; and a pressurizing member which pressurizes the pressure chamber in said pressure-chamber plate, allowing the ink in the pressure chamber to jet.

2. An inkjet head comprising:

a pressure-chamber plate which defines a pressure chamber for storing ink, and an ink chamber for supplying the ink to the pressure chamber, said pressure-chamber plate being divided into a plurality of elements; and a pressurizing member which pressurizes the pressure chamber in said pressure-chamber plate, allowing the ink in the pressure chamber to jet.

3. An inkjet head according to claim 2, wherein the elements include:

a first element which defines the pressure chamber; and a second element which defines the ink chamber, said pressure-chamber plate including an elastic member which connects the first element to the second element.

4. An inkjet head according to claim 3, wherein the elastic member is silicon adhesive.

5. An inkjet head according to claim 2, wherein the pressurizing member includes a piezo-electric element, and wherein said inkjet head further comprises:

a thin film located between the piezo-electric element and said pressure-chamber plate; and an elastic member which connects the thin film to the pressure-chamber plate, said piezo-electric element pressurizing said pressure chamber via said thin film.

6. An inkjet head according to claim 5, wherein the elastic member is silicon adhesive.

7. An inkjet head according to claim 5, wherein the elastic member connects the thin film to the pressure-chamber plate at a position opposite to the pressure chamber with respect to the ink chamber.

8. An inkjet head according to claim 1, wherein said pressurizing member includes a piezo-electric element, and wherein said inkjet head further comprises:

a thin film located between the piezo-electric element and said pressure-chamber plate; and an elastic member which connects the thin film to the pressure-chamber plate, said piezo-electric element pressurizing said pressure chamber via said thin film.

9. A recording device comprising:

an inkjet head; and a drive device which drives said inkjet head, wherein said inkjet head comprises:

a pressure-chamber plate which defines a pressure chamber for storing ink, and an ink chamber for supplying the ink to the pressure chamber, and which includes a slit between the pressure chamber and the ink chamber, said slit dividing said pressure-chamber plate into two parts, one of which defines said pressure chamber and the other of which defines said ink chamber; and a pressurizing member which pressurizes the pressure chamber in the pressure-chamber plate, allowing the ink in the pressure chamber to jet.

10. A recording device comprising:

an inkjet head; and a drive device which drives said inkjet head, wherein said inkjet head comprises:

a pressure-chamber plate which defines a pressure chamber for storing ink, and an ink chamber for supplying the ink to the pressure chamber, said pressure-chamber plate being divided into a plurality of elements; and a pressurizing member which pressurizes the pressure chamber in said pressure chamber and enables the ink in the pressure chamber to jet.

11. An inkjet head according to claim 2, wherein said plurality of elements includes an element having a perforation hole.

12. An inkjet head according to claim 3, wherein one of the first and second elements has a perforation hole used to introduce said elastic member.

13. An inkjet head according to claim 3, wherein the second element has a perforation hole used to introduce an elastic member, said hole being extending from an approximately center of the pressure chamber.

14. A recording device according to claim 10, wherein said plurality of elements includes an element having a perforation hole.

15. A recording device according to claim 10, wherein the elements in said piezo-electric plate include:

a first element which defines the pressure chamber; and a second element which defines the ink chamber, said pressure-chamber plate including an elastic member which connects the first element to the second element, and one of the first and second elements having a perforation hole used to introduce said elastic member.

16. A recording device according to claim 10, wherein the elements in said piezo-electric plate include:

a first element which defines the pressure chamber; and a second element which defines the ink chamber, said pressure-chamber plate including an elastic member which connects the first element to the second element, and the second element having a perforation hole used to introduce an elastic member, said hole being extending from an approximately central portion of the pressure chamber.

17. A method for manufacturing an inkjet head comprising the steps of:

adhering part of elements among a plurality of elements, a thin film, and a piezo-electric element which pressurizes a pressure chamber via the thin film to one another in a pressure-chamber plate which defines the pressure chamber for storing ink, and an ink chamber for supplying the ink to the pressure chamber, said pressure-chamber plate being divided into said plurality of elements; and forming a nozzle connection surface by abrading at least part of the elements and the thin film;

jointing to the nozzle connection surface a nozzle plate having a nozzle hole through which the ink is jet from the pressure chamber when the piezo-electric element pressurizes the pressure chamber; and adhering remaining elements of the pressure-chamber plate to the part of the elements.

18. A method according to claim 17, wherein said plurality of elements include an element having a perforation hole, and wherein said step of adhering the remaining elements to the part of the elements includes:

positioning at least one element among the remaining elements relative to the part of elements; and introducing elastic adhesive into the perforation hole.

19. A method according to claim 17, wherein said step of adhering the remaining elements to the part of the elements includes:

positioning at least one element among the remaining elements relative to the part of elements; and introducing elastic adhesive between the elements by using a capillary action.

* * * * *